US010337217B2

(12) United States Patent
Hogan et al.

(10) Patent No.: US 10,337,217 B2
(45) Date of Patent: Jul. 2, 2019

(54) LOW FRICTION LOCKING DEADBOLT

(71) Applicant: Schlage Lock Company LLC, Indianapolis, IN (US)

(72) Inventors: Michael Patrick Hogan, Carmel, IN (US); Brion Gregory St. Amour, New Palestine, IN (US)

(73) Assignee: Schlage Lock Company LLC, Carmel, IN (US)

( * ) Notice: Subject to any disclaimer, the term of this patent is extended or adjusted under 35 U.S.C. 154(b) by 1004 days.

(21) Appl. No.: 14/280,030

(22) Filed: May 16, 2014

(65) Prior Publication Data

US 2015/0330120 A1 Nov. 19, 2015

(51) Int. Cl.

| | |
|---|---|
| ***E05C 1/00*** | (2006.01) |
| ***E05B 47/00*** | (2006.01) |
| ***E05B 15/00*** | (2006.01) |
| ***E05B 15/02*** | (2006.01) |
| ***E05B 15/10*** | (2006.01) |
| ***E05B 17/00*** | (2006.01) |

(52) U.S. Cl.

CPC ..... *E05C 1/004* (2013.01); *E05B 15/0006* (2013.01); *E05B 15/0205* (2013.01); *E05B 15/102* (2013.01); *E05B 17/007* (2013.01); *E05B 47/0012* (2013.01); *E05B 47/0004* (2013.01); *E05B 2047/0058* (2013.01); *E05B 2047/0094* (2013.01); *Y10T 292/1014* (2015.04)

(58) Field of Classification Search

CPC .. E05C 1/004; E05B 47/0012; E05B 15/0006; E05B 15/102; E05B 17/007; E05B 15/0205; E05B 2047/0094; E05B 47/0004; E05B 2047/0058; Y10T 292/1014

See application file for complete search history.

(56) References Cited

U.S. PATENT DOCUMENTS 625,753 A * 5/1899 Forsyth ..... C09B 23/143 160/287
1,486,595 A * 3/1924 Marcum ..... E05B 85/22 292/169.11
1,741,258 A 12/1929 Utley
2,158,983 A 5/1939 Knoll (Continued)

OTHER PUBLICATIONS

International Search Report; International Searching Authority, US Patent and Trademark Office; International PCT Application No. PCT/US2015/031434; dated Aug. 19, 2015; 2 pages.

(Continued)

*Primary Examiner* — Kristina R Fulton
*Assistant Examiner* — Thomas L Neubauer
(74) *Attorney, Agent, or Firm* — Taft Stettinius & Hollister LLP

(57) ABSTRACT

An exemplary deadbolt includes a pair of rollers positioned on opposing sides of an axial centerline of the deadbolt. The deadbolt may include chamfers or tapered surfaces extending from side surfaces of the deadbolt toward a face of the deadbolt. The rollers may extend beyond the face, one of the side surfaces, and/or one of the tapered surfaces. As the bolt moves from a retracted position to an extended position, one of the rollers may engage an edge of an opening in a strike plate, for example when the deadbolt is misaligned with the strike plate opening. As the rollers engage the edge, the deadbolt may be urged to a more aligned position.

19 Claims, 6 Drawing Sheets

(56) References Cited

U.S. PATENT DOCUMENTS

| | | | | | |
|---|---|---|---|---|---|
| 2,349,301 | A | * | 5/1944 | Overby | E05B 17/007 292/169.21 |
| 2,445,119 | A | * | 7/1948 | Ledin | E05C 19/04 292/33 |
| 2,541,720 | A | | 2/1951 | Robinson | |
| 3,191,980 | A | | 6/1965 | Whalen | |
| 3,322,450 | A | * | 5/1967 | Russell | E05C 19/04 292/75 |
| 3,561,803 | A | * | 2/1971 | Schlage | E05B 63/22 292/143 |
| 4,677,834 | A | | 7/1987 | Hicks | |
| 4,703,637 | A | * | 11/1987 | Diemert | E05B 17/0029 292/144 |
| 4,813,724 | A | | 3/1989 | Dietrich | |
| 5,290,077 | A | | 3/1994 | Fleming | |
| 5,987,818 | A | | 11/1999 | Dabideen | |
| 6,592,156 | B2 | * | 7/2003 | Levine | E05C 19/04 292/23 |
| 6,746,060 | B2 | * | 6/2004 | O'Brien, II | E05B 65/1046 292/337 |
| 6,902,137 | B2 | | 6/2005 | Brzeski et al. | |
| 8,047,582 | B1 | | 11/2011 | Rodgers et al. | |
| 2008/0276672 | A1 | | 11/2008 | Gartner | |

OTHER PUBLICATIONS

Falcon TD 35 Roller Strike Installation.
Canadian Office Action; Canadian Intellectual Property Office; Canadian Patent Application No. 2,955,759; dated Dec. 1, 2017; 3 pages.

* cited by examiner

LOW FRICTION LOCKING DEADBOLT

TECHNICAL FIELD

The present invention relates to deadbolt locking systems, and more particularly, but not exclusively, to deadbolt locking systems in which friction and/or misalignment may hinder the extension of the bolt into a locking position.

BACKGROUND

In deadbolt locking systems, the bolt and a bolt-accepting passage (such as a strike plate opening) may become misaligned, for example due to improper installation or warping. In such a case, friction between the bolt and the strike plate may oppose movement of the bolt, increasing the amount of force required to move the bolt between extended and retracted positions. Furthermore, if the misalignment is severe, the bolt face may contact the flat surface of the strike plate such that no amount of force would be sufficient to throw the bolt through the bolt passage without damaging a portion of the system. In either case, a user may need to manually align the bolt and the bolt passage—for example by pushing or pulling on a portion of the lock system—before the bolt can extend or retract.

In recent years, electronic deadbolt systems have gained popularity. When misalignment occurs in such systems, the throwing mechanism may be unable to produce the force required to overcome frictional forces and throw the bolt through the bolt passage. In such cases, a user may need to manually align the system. Furthermore, when the electronic locking mechanism is battery-powered, there is a significant trade-off between battery life and the force required to throw the bolt. Certain electronic locking mechanisms include remote locking features, whereby a user can lock the system from a remote location. In such a case, the user is not available to manually align the system, and remote locking may become impracticable.

Misalignment is of particular concern when a close fit between the bolt and the strike plate is desired. In such a case, the strike plate opening may be only slightly larger than the bolt, and even a slight misalignment may give rise to the issues described above. With the problems presented by the competing concerns for a close fit and misalignment tolerance, a need exists for further contributions to this area of technology.

SUMMARY

An exemplary deadbolt includes a pair of rollers positioned on opposing sides of an axial centerline of the deadbolt. The deadbolt may include chamfers or tapered surfaces extending from side surfaces of the deadbolt toward a face of the deadbolt. The rollers may extend beyond the face, one of the side surfaces, and/or one of the tapered surfaces. As the bolt moves from a retracted position to an extended position, one of the rollers may engage an edge of an opening in a strike plate, for example when the deadbolt is misaligned with the strike plate opening. As the rollers engage the edge, the deadbolt may be urged to a more aligned position. Further embodiments, forms, features, aspects, benefits, and advantages of the present application shall become apparent from the description and figures provided herewith.

DETAILED DESCRIPTION OF ILLUSTRATIVE EMBODIMENTS

Figure 1:
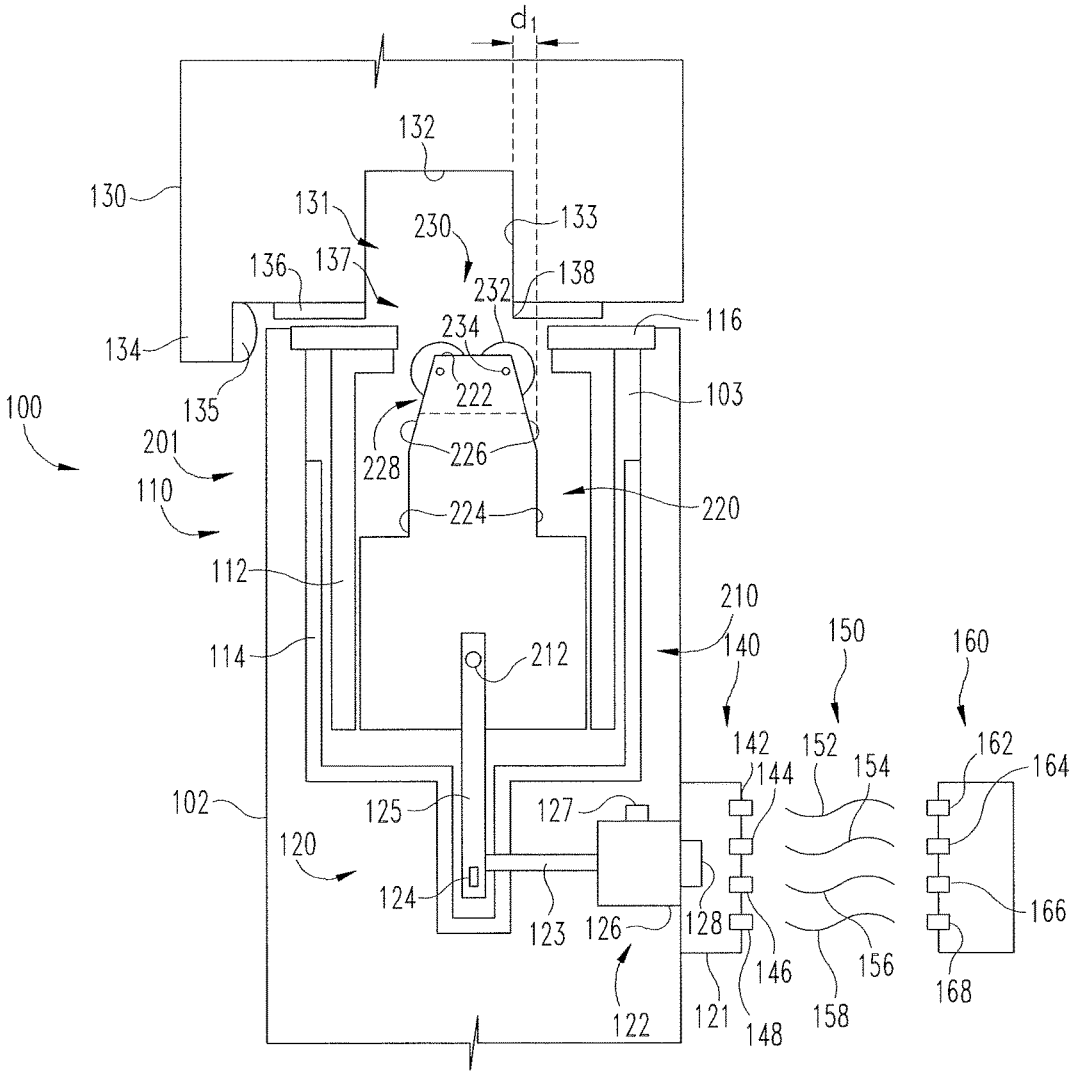
FIG. 1 is a schematic illustration of an illustrative deadbolt locking system in an unlocking position.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated embodiments, and that such further applications of the principles of the invention as illustrated therein as would normally occur to one skilled in the art to which the invention relates are contemplated and protected.

Figure 2:
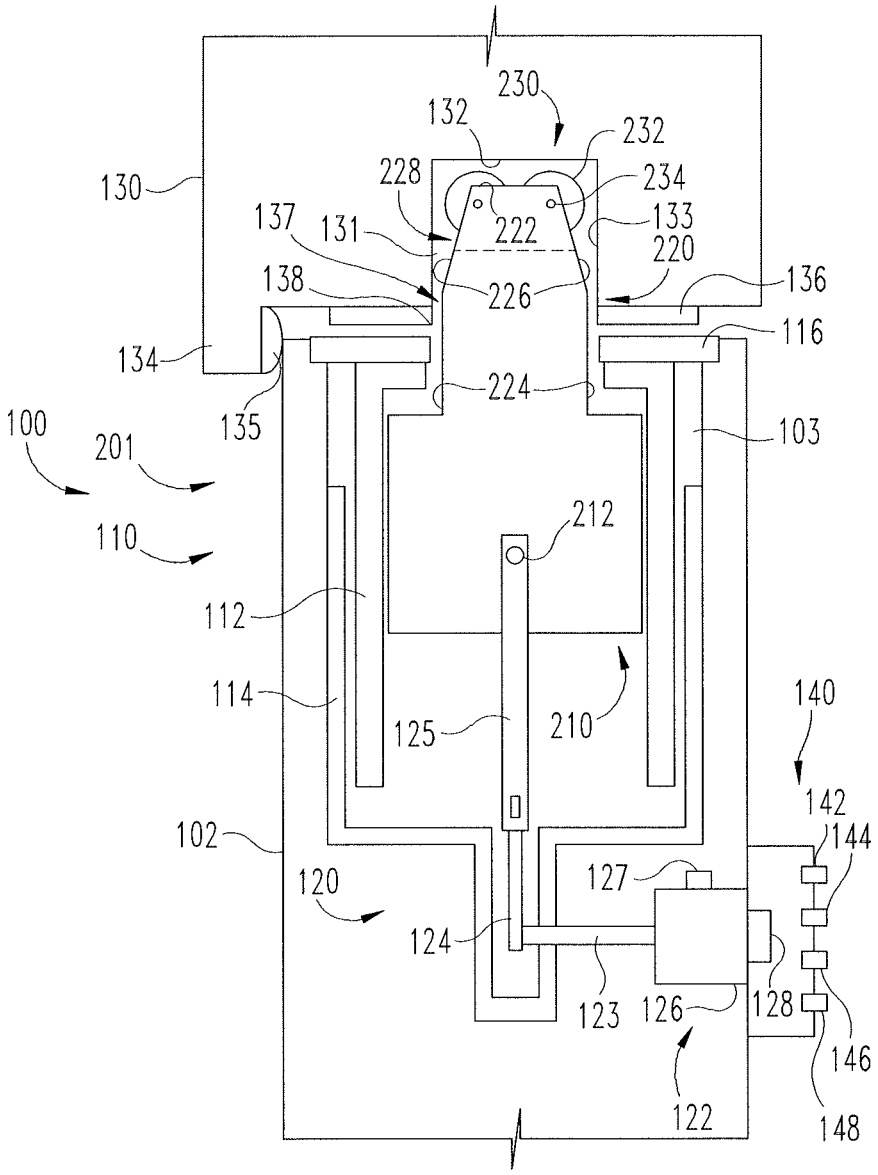
FIG. 2 depicts the deadbolt locking system of FIG. 1 in a locking position.
Figure 3:
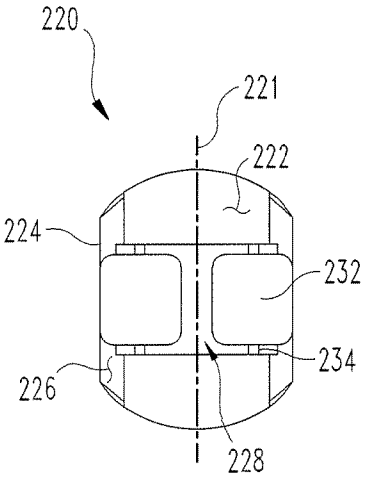
FIG. 3 is an elevational illustration of a front end of an exemplary deadbolt including rollers.

With reference to FIGS. 1-3, an illustrative locking system 100 includes a housing assembly 110, a throwing system 120, and a bolt 200 such as a deadbolt. In certain forms, the bolt 200 may comprise a portion of a deadbolt assembly 201, which may further comprise the housing assembly 110. The exemplary locking system 100 is mounted on a door 102, such that at least a portion of the deadbolt assembly 201 is positioned in a door cross-bore 103. The bolt 200 is positioned in the housing assembly 110, and is operably connected to the throwing system 120. The door 102 may be associated with a door frame 130 which includes a bolt-accepting cavity 131. The frame 130 may further include a door stop 134 having weather stripping 135 mounted thereon. A strike plate 136 including an opening 137 may be mounted on the frame 130 such that the strike plate opening 137 is substantially aligned with the cavity 131.

The housing assembly 110 is positioned at least partially in the cross-bore 103, and includes a housing 112, a casing 114 in which the housing 112 is seated, and a faceplate 116. The faceplate 116 is fastened to the door 102, retaining the housing 112 and the casing 114 within the cross-bore 103. When assembled, the bolt 200 is positioned at least partially in the housing assembly 110, and is operable to extend and retract through openings in the housing 112 and the faceplate 116.

The throwing system 120 is coupled to the bolt 200, and is operable in a retracted state wherein the bolt 200 is in a retracted, unlocking position (FIG. 1) and an extended state wherein the bolt 200 is in an extended, locking position (FIG. 2). The exemplary throwing system 120 includes a user interface 121, a throwing mechanism 122 operable via the user interface 121, a rotor 123 operably connected to the throwing mechanism 122, a swing arm 124 coupled to the rotor 123, and a rigid member 125 connected to the swing arm 124. The rigid member 125 is also coupled to the bolt 200, for example via a throwing hub 212. The throwing hub 212 may comprise a fastener, protrusion, cavity, or another structure capable of coupling the bolt 200 to the rigid member 125.

In the illustrated form, the throwing system 120 is an electronic throwing system operable to electrically extend and retract the bolt 200. The exemplary throwing mechanism 122 comprises an electromechanical actuator such as a motor 126, and the throwing system 120 receives power from an energy storage device such as a battery 127. It is also contemplated that the throwing system 120 may be powered by line power and/or another form of energy storage device such as a super-capacitor. The user interface 121 may comprise an input 140 configured to receive a user command 150 issued by or on behalf of a user 160, and a controller 128 configured to actuate the motor 126 in response to the user command 150.

During operation of the illustrated throwing system 120, actuation of the motor 126 provides a torque to the rotor 123; the torque rotates the swing arm 124, which exerts a substantially linear force on the rigid member 125. This linear force is transmitted through the rigid member 125 to the bolt 200, causing the bolt 200 to extend or retract. It is also contemplated that the throwing system 120 may extend and retract the bolt 200 by another method. For example, the throwing system 120 may include a linear actuator (not illustrated) such as a solenoid, which may be directly coupled to the rigid member 125, such that the linear actuator is operable to extend and retract the bolt 200 without rotational or pivotal movement. In other forms, the swing arm 124 may be pivotally mounted, with one end coupled to the rigid member 125, and an opposing end may be coupled to a linear actuator, such that the linear actuator extends or retracts the bolt 200 by pivoting the swing arm 124 about its pivot point.

The user command 150 may, for example, be issued vocally, manually, or via a wireless signal such as an electromagnetic wave. In certain forms, the input 140 may include a credential reader 142 configured to receive and authenticate a wireless user command 152 comprising a credential, which may be issued from a token or wireless communication device 162 such as a keycard, fob, or smart phone. In other forms, the input 140 may include a manually operable input 144 such as a button or keypad configured to receive a manual user command 154 such as the entry of a code, for example with the user's hand 164. In further embodiments, the input 140 may include a microphone 146 configured to receive an audible user command 156, which may be a vocal command issued with the user's voice 166. In still further forms, the input 140 may include a motion sensor 148 configured to sense a motion-based user command 158 such as a gesture or the user 160 approaching the door; the user 160 may, for example, issue the motion-based user command 158 using their body or appendages 168.

In certain embodiments, the user interface 121 may be configured to receive a remote user command 150. The remote user command 150 may be issued by or on behalf of a user 160 that is not within arm's reach—for example, within three feet—of the door 102, and is thus unable to manually align the bolt body 200 with the strike plate opening 137. In certain forms, the user interface 121 may be positioned on or near the door 102, and the remote user command 150 may be issued by or on behalf of a user 160 who is not near the user interface 121. For example, the user 160 may issue the wireless user command 152 via the wireless communication device 162, which may, for example, be a smart phone. As another example, the user 160 may issue the vocal or motion-based user command 156, 158, for example by speaking the vocal command 156 or approaching the motion sensor 148. In other forms, the user interface 121 may be positioned at a remote location with respect to the door 102, and the remote user command 150 may be issued by or on behalf of a user 160 who is near the user interface 121, but remote with respect to the door 102. In such a case, the remote user command 150 may also include the manual user command 154.

While the illustrated throwing system 120 is an electronic throwing system, it is also contemplated that a mechanical form of the throwing system 120 may be utilized. For example, the manual input 144 may include a manually operable thumb turn which, when actuated, rotates the rotor 123 either directly or through the throwing mechanism 122.

The bolt 200 is seated in the housing assembly 110, and comprises a proximal end portion or first end 210, a distal end portion or second end 220, and a roller assembly 230. The first end 210 is connected to the throwing system 120 via the throwing hub 212. When the throwing system 120 is in the retracted state and the bolt 200 is in the unlocking position (FIG. 1), the second end 220 is positioned substantially entirely within the housing assembly 110. When the throwing system 120 is in the extended state and the bolt 200 is in the locking position (FIG. 2), at least a portion of the second end 220 extends out of the housing assembly 110, through the strike plate opening 137, and into the cavity 131. The first end 210 may have a width greater than that of the second end 220, such that the second end 220, but not the first end 210, can pass through openings in the housing 112 and faceplate 116.

The second end 220 defines a bolt face 222 and side-surfaces 224, and may further include chamfers or tapered surfaces 226. In the illustrated form, the tapered surfaces 226 comprise a substantially rectilinear profile; it is also contemplated that one or more of the tapered surfaces 226 may comprise a curvilinear portion, which may, for example, be convex or concave. It is also contemplated that the tapered surfaces 226 may be omitted, and that the side surfaces 224 may extend to the bolt face 222. The second end 220 also includes a cavity or opening 228 extending axially inward from the bolt face 222. The opening 228 is configured to receive the roller assembly 230, such that the roller assembly 230 may be coupled to the second end 220.

As best seen in FIG. 3, the roller assembly 230 includes a pair of rollers 232, each of which is partially positioned in the opening 228 and rotatably mounted to the second end 220, for example by an axle 234. In the illustrated form, both of the rollers 232 are positioned in a single continuous opening 228; it is also contemplated that the opening 228 may comprise discrete cavities, and that each of the rollers 232 may be positioned in one of the cavities. The rollers 232 are positioned on opposite sides of a central axial plane 221 of the second end 220, such that the axles 234 are offset from the central axial plane 221 by predetermined offset distances. In the illustrated form, the axles 234 are offset from the central axial plane 221 by substantially equal offset distances, although it is also contemplated that the offset distances of the axles 234 may be different. As best seen in FIGS. 1 and 2, each of the rollers 232 protrudes beyond the bolt face 222, and may also protrude beyond one of the tapered surfaces 226.

In the illustrated form, the axles 234 enable rotation, but not linear movement, of the rollers 232. That is to say, while the rollers 232 are rotatable, they have a fixed linear position with respect to the bolt 200. In certain forms, the axles 234 may be formed integrally with the rollers 232. For example, an axle 234 may comprise protrusions at the rotational axis of the roller 232, and the protrusions may matingly engage recesses formed in the second end 220. The protrusions and recesses may be configured to enable the rollers 232 to be mounted to the second end 220 via a snap fit connection. It is also contemplated that the protrusions may be formed on the second end 220 and extend into the opening 228, and the recesses may be formed at the rotational axis of the roller 232. In other forms, the axle 234 may be a separate piece. For example, an axle 234 may comprise a rod extending through openings in the second end 220 and the roller 232. Such axles 234 may further be equipped with friction-reducing features, such as bearings.

During operation of the system 100, the bolt 200 may become misaligned with the strike plate opening 137, even when the door 102 is closed. The misalignment may be unintentional, for example due to warping of the door 102, thermal expansion or contraction, or faulty installation of one of the elements of the system 100. In some cases, misalignment may be intentionally provided, for example to ensure a tight fit, or to compress the weather stripping 135 when the door 102 is closed and the bolt 200 is extended (FIG. 2).

FIG. 1 illustrates the bolt 200 in a first misaligned position, wherein one of the bolt side surfaces 224 is offset from an edge 138 of the strike plate opening 137 by a misalignment distance $d_1$. When the throwing system 120 exerts an extending force on the bolt 200, the bolt 200 moves toward the extended position, and one of the rollers 232 contacts the edge 138 such that the roller 232 exerts a force on the edge 138. The edge 138, in turn, exerts an opposing force on the roller 232. The opposing force includes an axial force vector opposing extension of the bolt 200, and a radial force vector which urges the bolt 200 into a more aligned position. As the throwing system 120 continues to exert the extending force on the bolt 200, the opposing radial force vector continues to urge the second end 220 into alignment with the strike plate opening 137. Once the second end 220 is aligned with the opening 137, the bolt 200 can continue to extend toward the locking position (FIG. 2). After the roller 232 enters the cavity 131, the roller 232 may continue to reduce friction by rolling along a side surface 133 of the cavity 131. During retraction of the bolt 200, the roller 232 may likewise reduce friction by rolling along the cavity side surface 133.

As can be seen from the foregoing, the rollers 232 reduce friction during extension and retraction of the bolt 200. When the deadbolt assembly 201 is not properly aligned with the strike plate 136, the rollers 232 may also urge the second end 220 into alignment with the strike plate opening 137 as the bolt 200 moves to the extended position. In some applications, misalignment may occur in either direction. For example, warping of the door 102 create a first misalignment in a first direction, and deterioration or improper installation of the frame 130, door stop 134, and/or weather stripping 135 may cause a second misalignment in a second, opposite direction. Thus, the deadbolt assembly 201 may be operable in an aligned position wherein the second end 220 is aligned with the strike plate opening 137, a first misaligned position wherein the second end 220 is misaligned with the strike plate opening 137 in the first direction, and a second misaligned position wherein the second end 220 is misaligned with the strike plate opening 137 in the second direction. In such a case, during extension of the bolt 200, a first of the rollers 232 may engage a first strike plate edge 138 when the door 102 is warped, and the other roller 232 may engage the other strike plate edge 138 when the weather stripping 135 is deteriorated.

When the bolt 200 is in the retracted position and the deadbolt assembly 201 is in the aligned position, the side surfaces 224 are aligned with the strike plate opening 137, such that extension of the bolt 200 causes the second end 220 to enter the strike plate opening 137. When the bolt 200 is in the retracted position and the deadbolt assembly 201 is in the first misaligned position (FIG. 1), a first of the edges 138 is aligned with a first of the rollers 232, and may additionally be aligned with a first of the tapered surfaces 226. In this state, extension of the bolt 200 causes the first edge 138 to engage the first roller 232 as described above, thereby urging the deadbolt assembly 201 toward the aligned position. When the bolt 200 is in the retracted position and the deadbolt assembly 201 in the second misaligned position, the second of the edges 138 is aligned with the second of the rollers 232, and may additionally be aligned with the second of the tapered surfaces 226. In this state, extension of the bolt 200 causes the second edge 138 to engage the second roller 232 as described above, thereby urging the deadbolt assembly 201 toward the aligned position.

While the illustrated rollers 232 comprise substantially similar diameters, it is also contemplated that one of the rollers 232 may comprise a greater diameter than the other roller 232. For example, if it is anticipated that misalignment due to warping of the door 102 will be of greater concern than misalignment due to deterioration of the weather stripping 135, the first roller 232 may comprise a greater diameter than the second roller 232. The fact that the diameter of the first roller 232 is greater than that of the second roller 232 may enable the deadbolt assembly 201 to accommodate greater misalignment in the first direction than in the second direction. In certain forms, one of the rollers 232 may cross the central axial plane 221.

Figure 4:
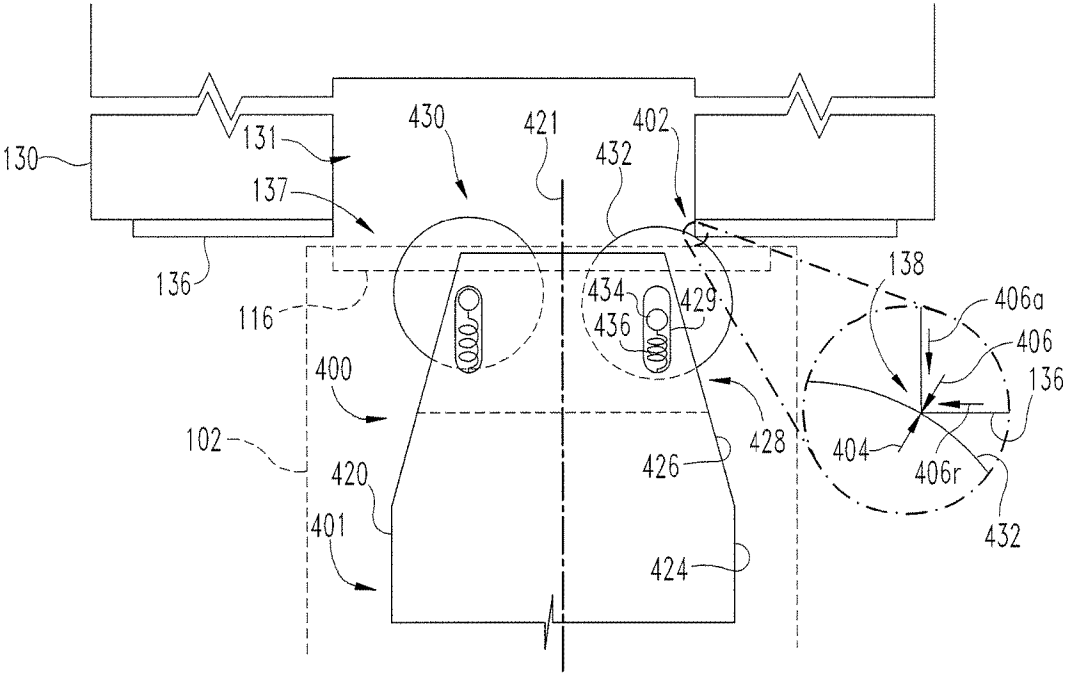
FIG. 4 depicts an illustrative deadbolt including movable rollers.

FIG. 4 depicts a portion of a second illustrative bolt 400 including a movable roller assembly 430. The bolt 400 is substantially similar to the previously-described bolt 200; unless indicated otherwise, similar reference characters are used to indicate similar elements. As previously described, each of the rollers 432 is seated in the cavity 428, and is rotatably mounted to the second end 420 by an axle 434. A first of the rollers 432 is positioned on a first side of a longitudinal axis 421 of the second end 420, and the second of the rollers 432 is positioned on a second, opposite side of the longitudinal axis 421. In the present form, each of the rollers 432 is also linearly movable with respect to the bolt 400. Each of the axles 434 extends into a channel 429 formed in the second end 420, such that the rollers 432 are movable with respect to the bolt 400 by a distance corresponding to the length of the channels 429. Each of the axles 434 may be associated with a biasing member or spring 436, such that the rollers 432 are urged in the direction of extension of the bolt 400. As such, each of the rollers 432 is operable in a retracted roller position and an extended roller position, and is biased toward the extended roller position substantially in the direction of bolt 400 extension.

While the illustrated channels 429 are substantially parallel to the longitudinal axis 421, it is also contemplated that one or more of the channels 429 may be angularly offset from the longitudinal axis 421, for example at an oblique angle. For example, one or more of the channels 421 may be parallel, substantially parallel, perpendicular, or substantially perpendicular to the corresponding tapered surface 428. In embodiments which employ such angularly offset channels 429, the springs 436 may bias the rollers 432 to the extended roller position, and the direction of biasing may be at least partially in the direction of bolt 400 extension. Furthermore, one or more of the channels 429 may be curved.

In certain forms, one or more of the rollers 432 may protrude beyond the faceplate 116, even when the bolt 400 is in the retracted position. In such a case, as the door 102 is closed, the strike plate 136 may urge the rollers 432 inward (i.e. further into the opening 428) against the force of the springs 436. When the door 102 reaches the closed position, one of the rollers 432 may form an initial contact point 402 with the strike plate edge 138, for example if the second end 420 is misaligned with the strike plate opening 137. That is to say, when the bolt 400 is in the retracted position and the deadbolt assembly 401 in a misaligned position, the strike plate 136 may urge one of the rollers 432 toward the retracted roller position.

The biasing force provided by the spring 436 may urge the roller 432 outward (i.e. further out of the opening 428), creating an initial force vector 404 prior to linear force being applied to the bolt 400 by the throwing system (not illustrated). In such a case, the strike plate 136 creates an initial opposing force 406 including an initial axial force vector **406*a* which compresses the spring 436 and an initial radial force vector 406*r* which urges the roller 432 toward the strike plate opening 137. The initial radial force vector 406*r* may provide partial alignment of the bolt 400 prior to force being applied by the throwing system. As the bolt 400 moves toward the extended position, the interaction between the roller 432 and the strike plate 136 continues to urge the bolt 400 to the aligned position as described above with reference to the deadbolt assembly 201. Additionally, as the bolt 400 extends, the spring 436 urges the roller 432 in the direction of bolt extension; the energy stored in the compressed spring 436 may supplement the force provided by the throwing system as the spring 432** expands from the compressed state.

Figure 5:
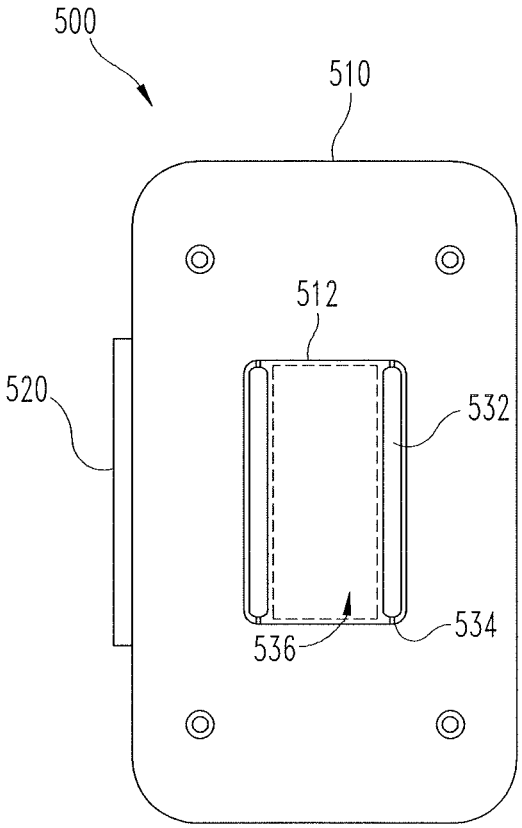
FIG. 5 is an illustration of an exemplary strike plate including rollers.
Figure 6:
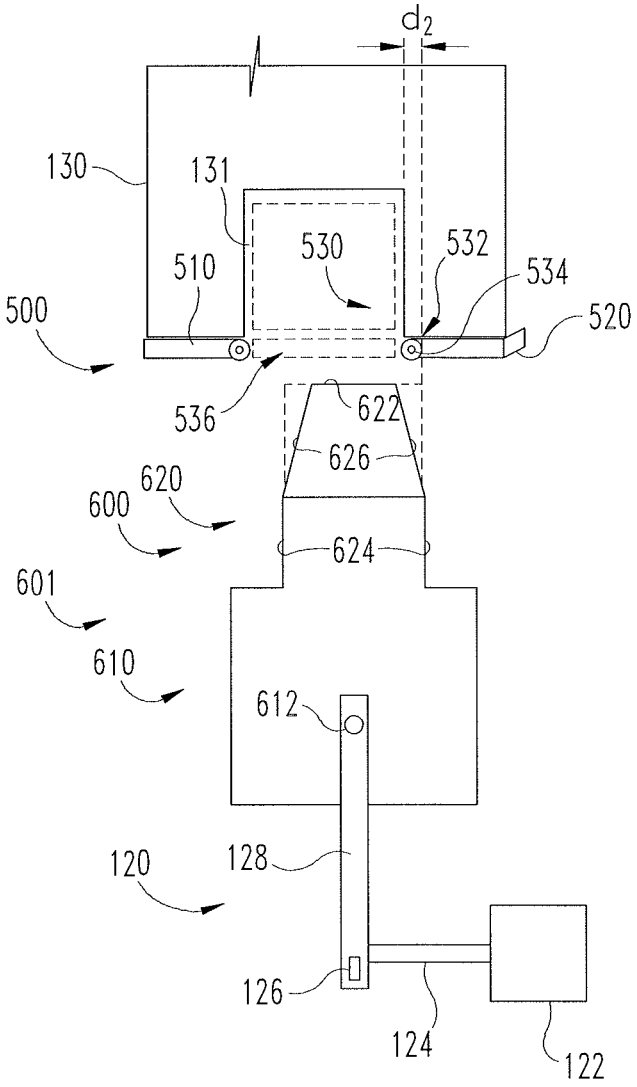
FIG. 6 depicts a second illustrative deadbolt locking system including the strike plate illustrated in FIG. 5.

With reference to FIGS. 5 and 6, an illustrative strike plate assembly 500 includes a strike plate 510 including a through-hole 512, a strike plate roller assembly 530, and may further include a flange 520 extending at an oblique angle with respect to the strike plate 510. FIG. 6 also depicts an illustrative bolt 600, which is operably connected to the exemplary throwing system 120. The bolt 600 is similar to the previously-described bolt 200; unless indicated otherwise, similar reference characters are used to indicate similar elements. While previously-described bolt 200 includes a roller assembly 230, the present bolt 600 does not include such a roller assembly.

The illustrative strike plate roller assembly 530 includes a pair of rollers 532 rotatably mounted to the strike plate 510. The rollers 532 are mounted to the strike plate 510 at opposing sides of the through-hole 512, such that the rollers 532 define a strike plate opening 536 therebetween. As best seen in FIG. 6, the strike plate assembly 500 may be mounted on the door frame 130, such that the strike plate opening 536 is substantially aligned with the cavity 131. The opening 536 may comprise dimensions corresponding to the dimensions of the bolt second end 620. For example, the width of the opening 536 (i.e. the distance between the rollers 532) may comprise a sum of the width of the second end 610 (i.e. the distance separating the side-surfaces 624) and a tolerance distance. In situations where a close fit is desired, the tolerance distance may be relatively small, for example less than 1 mm, and may be zero. If the strike plate rollers 532 are flexible and/or compressible, the tolerance distance may be a negative value, such that the rollers 532 elastically deform as the bolt second end 620 extends into the opening 536, providing a tight fit. The cavity 131 may comprise a width that is the same or substantially the same as that of the strike plate opening 536, or may further comprise a second tolerance distance.

In certain embodiments, the strike plate rollers 532 are rotatably mounted on a fixed axis 534. In such embodiments, the strike plate rollers 532 are free to rotate, but cannot move linearly with respect to the strike plate 510. A fixed axis may comprise, for example, an axle extending through a bore in the roller 532, or an indentation formed on one of the strike plate 510 and the roller 532 and a mating protrusion formed on the other of the strike plate 510 and the roller 532. In other forms, one or more of the rollers 532 may be linearly movable with respect to the strike plate 510; for example, the axle 534 and a spring may be positioned in a channel formed in the strike plate in a manner similar to the previously described roller assembly 430.

With specific reference to FIG. 6, a second illustrative locking process will now be described. The second end 620 is shown as misaligned with the strike plate opening 536 by a distance $d_2$. When the throwing system 120 exerts an extending force on the bolt 600, the bolt 600 extends toward a locking position. When the bolt 600 is not properly aligned with the opening 536, the strike plate roller 532 contacts the chamfer or tapered surface 626. As force continues to be applied by the throwing system 120, the bolt 600 exerts a force on the strike plate roller 532, which exerts an opposing force on the bolt 600. In a manner similar to that described above with respect to FIGS. 1 and 2, the opposing force urges the bolt 600 into a more aligned position, until the bolt face 622 is positioned in the cavity 131, and the tapered surface 626 is no longer in contact with the roller 532. Once this occurs, the roller 532 may continue to reduce friction by rolling along the bolt side-surface 624. When the bolt 600 is extended to the locking position, at least a portion of the second end 620 is positioned in the cavity 131.

Figure 7:
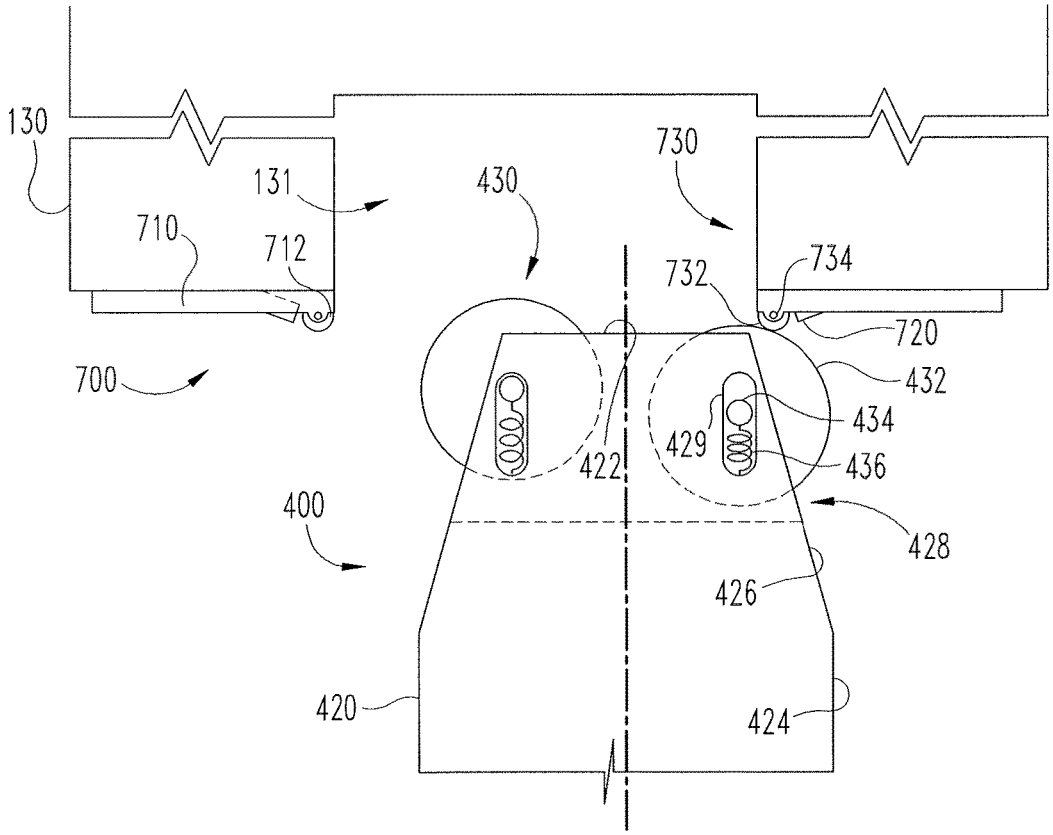
FIG. 7 is a schematic illustration of a third illustrative deadbolt locking system comprising an illustrative strike plate including rollers and a deadbolt including movable rollers.

In certain embodiments of the present invention, a set of rollers may be provided to both the strike plate and the bolt. FIG. 7 depicts the previously-described bolt 400 along with a second illustrative strike plate assembly 700. The strike plate assembly 700 includes a strike plate 710 and a roller assembly 730 including strike plate rollers 732 rotatably mounted to the strike plate 710, for example via axles 734. The strike plate 710 may further include protrusions 712 to which the axles 744 may rotatably coupled, such that the rollers 732 may comprise a greater diameter than would otherwise be possible without cutting into the frame 130. In certain forms, the protrusion 712 may include a channel, and the axles 734 may be seated in the channels with a spring, to enable the strike plate rollers 732 to move linearly with respect to the strike plate 710. The strike plate assembly 700 may further include one or more ramps 720 configured to urge the bolt rollers 432 inward (i.e. further into the opening 428) as the door 102 is closed, such that the bolt rollers 432 can smoothly transition into engagement with the strike plate rollers 732.

As can be seen from the foregoing, the illustrative roller assemblies described herein reduce friction as a bolt moves between its locking and unlocking positions. When utilized with electronic throwing assemblies comprising a motor or another form of electromechanical actuator, the reduced friction enables the motor to extend and retract the bolt using less current than would otherwise be required. Additionally, the roller assemblies may further serve to align the bolt with a strike plate opening as the bolt extends to the locking position. In other words, the roller assemblies may enable the bolt to extend to the locking position while also providing the proper alignment between the bolt and a bolt-accepting cavity. As such, the system can be locked without requiring manual adjustment of the system, which may be unavailable if the user is not present at the door.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred, more preferred or exemplary utilized in the description above indicate that the feature so described may be more desirable or characteristic, nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A locking system, comprising:

a strike plate including a strike plate opening, wherein the strike plate opening is defined in part by a first edge and an opposite second edge; and a deadbolt assembly operable in an aligned position and a first misaligned position with respect to the strike plate, the deadbolt assembly comprising:

a deadbolt operable in an extended position and a retracted position, the deadbolt comprising a proximal end portion and a distal end portion, the distal end portion including a deadbolt end face, a central axial plane, a first side surface positioned on a first side of the central axial plane, and a second side surface positioned on a second, opposite side of the central axial plane, the first side surface and the second side surface extending to the deadbolt end face, the deadbolt end face intersecting the central axial plane, and wherein the first side surface further comprises a first chamfer tapering inward from the first side surface to the deadbolt end face toward the central axial plane; and a roller assembly including first and second rollers, wherein the first and second rollers are rotatably mounted to the distal end portion on opposite sides of the central axial plane, the first roller protruding beyond both the deadbolt end face and the first side surface, the second roller protruding beyond both the deadbolt end face and the second side surface, wherein, with the deadbolt in the retracted position and the deadbolt assembly in the aligned position, the first and second side surfaces are aligned with the strike plate opening;

wherein, with the deadbolt in the retracted position and the deadbolt assembly in the first misaligned position, the first chamfer is aligned with the first edge, the first roller is aligned with the first edge, and wherein the first edge engages the first roller and moves the deadbolt assembly toward the aligned position in response to motion of the deadbolt from the retracted position toward the extended position;

wherein the deadbolt assembly is further operable in a second misaligned position;

wherein, with the deadbolt in the retracted position and the deadbolt assembly in the second misaligned position, the second roller is aligned with the second edge, and wherein the second edge engages the second roller and moves the deadbolt assembly toward the aligned position in response to motion of the deadbolt from the retracted position toward the extended position;

wherein the second side surface further comprises a second chamfer tapering inward to the deadbolt end face toward the central axial plane; and wherein, with the deadbolt in the retracted position and the deadbolt assembly in the second misaligned position, the second chamfer is aligned with the second edge.

2. The locking system of claim 1, wherein the strike plate includes a through-hole, the locking assembly further comprising:

first and second strike plate rollers rotatably mounted to the strike plate at opposing sides of the through-hole such that the first and second strike-plate rollers respectively define the first and second edges of the strike plate opening, the strike plate opening comprising a width corresponding to a width of the distal end portion.

3. The locking system of claim 1, wherein the distal end portion further includes a tapered surface extending from the first side surface toward the deadbolt end face, and wherein one of the rollers extends beyond the tapered surface.

4. The locking system of claim 1, further comprising a throwing system operably connected with the deadbolt assembly, and operable to move the deadbolt between a locking position in which the deadbolt extends into the strike plate opening, and an unlocking position in which the deadbolt does not extend into the strike plate opening.

5. The system of claim 4, wherein the throwing system comprises an electronic throwing mechanism structured to receive a user command, and to move the deadbolt from one of the locking and unlocking positions to the other of the locking and unlocking positions in response to the user command.

6. The locking system of claim 1, wherein the first roller is movable with respect to the deadbolt, is operable to translate relative to the deadbolt between a retracted roller position and an extended roller position, and is biased at least partially in a direction of deadbolt extension toward the extended roller position.

7. The locking system of claim 6, wherein, with the deadbolt in the retracted position and the deadbolt assembly in the first misaligned position, the first roller is moved toward the retracted roller position by engagement of the first roller with the strike plate.

8. The locking system of claim 1, further comprising an electricity-powered throwing system including a receiver configured to receive a user command, and an electromechanical throwing mechanism configured to move the deadbolt toward one of the extended and retracted positions in response to the user command.

9. The locking system of claim 8, wherein the user command comprises a remote user command issued by or on behalf of a user positioned at least three feet from the deadbolt assembly.

10. A system, comprising:

a deadbolt assembly including:

a bolt housing mountable in a door cross-bore;

a deadbolt positioned at least partially in the housing, and comprising an end portion including a bolt end face and an opening extending axially inward from the bolt end face, the bolt end face positioned between opposing sides of the end portion of the bolt, the deadbolt operable in a retracted position and an extended position, wherein the end portion protrudes from the housing in the extended position, and wherein the deadbolt defines first and second guide channels, each guide channel having a first end and an opposite second end;

first and second rolling elements rotatably mounted to the end portion and positioned partially in the opening such that each rolling element extends beyond the bolt end face, wherein each rolling element includes a corresponding axle about which the rolling element is rotatable, wherein each axle extends into a corresponding one of the guide channels such that the first and second rolling elements are operable to translate along the first and second guide channels; and a biasing assembly including one or more springs, wherein the one or more springs are engaged with the first and second rolling elements and urge the first and second rolling elements toward the first ends of the first and second guide channels; and an electronic throwing assembly comprising:

a receiver configured to receive a user command; and an electromechanical throwing mechanism configured to move the deadbolt from the retracted position to the extended position in response to the user command.

11. The system of claim 10, wherein the first rolling element is positioned on an opposite side of a longitudinal axis of the end portion as the second rolling element.

12. The system of claim 11, wherein the end portion includes a tapered surface extending from one of the opposing sides of the deadbolt toward the bolt face, and wherein the first rolling element extends beyond the tapered surface.

13. The system of claim 12, wherein the user command comprises a remote user command issued by or on behalf of a user located at least three feet from the deadbolt assembly.

14. The system of claim 12, further comprising an energy storage device operable to provide electrical power to the electronic throwing assembly.

15. The system of claim 10, wherein the first rolling element is movably mounted to the bolt for translational movement between a first position and a second position, wherein the first rolling element extends beyond the bolt face by a greater distance in the second position than in the first position, and wherein the first rolling element is biased toward the second position by a spring.

16. The system of claim 15, wherein, with the deadbolt in the retracted position and the first rolling element in the second position, the first rolling element protrudes from the housing.

17. A deadbolt assembly, comprising:

a bolt housing configured for mounting in a bore of a door;

a deadbolt movably mounted in the housing for translation along a longitudinal axis, wherein the deadbolt is operable to translate relative to the housing between an extended deadbolt position and a retracted deadbolt position, wherein the deadbolt has a central axial plane defined along the longitudinal axis, and wherein the deadbolt comprises:

an end face, wherein the central axial plane intersects the end face, and wherein the end face has an end face width;

a pair of side surfaces formed on opposite sides of the central axial plane, wherein the side surfaces are offset from one another and define a bolt width, and wherein the bolt width is greater than the end face width;

a pair of tapered surfaces, wherein each of the tapered surfaces extends between the end face and a corresponding one of the side surfaces;

a cavity connected with the end face and the pair of tapered surfaces; and a pair of guide channels positioned on opposite sides of the central axial plane;

a roller assembly comprising a pair of rollers movably seated in the cavity, wherein each of the rollers includes a corresponding axle defining a rotational axis, wherein each axle extends into a corresponding one of the guide channels and is operable to translate relative to the deadbolt along a guide path defined by the corresponding guide channel, wherein each roller is mounted for rotation relative to the deadbolt about the rotational axis defined by the corresponding axle, wherein each roller is mounted for translation relative to the deadbolt along the guide path defined for the corresponding axle, and wherein each roller is configured to translate between an extended roller position and a retracted roller position; and a biasing assembly engaged between the deadbolt and the roller assembly, wherein the biasing assembly includes one or more springs, and wherein the biasing assembly biases each roller toward the corresponding extended roller position.

18. The deadbolt assembly of claim 17, wherein each guide path extends at least partially in a direction of the longitudinal axis.

19. A system, comprising:

the deadbolt assembly of claim 17; and a strike plate including a strike plate opening, wherein the strike plate opening is defined in part by a first edge and an opposite second edge, wherein the first edge and the second edge are offset from one another and define an opening width, and wherein the opening width is greater than the bolt width such that the strike plate opening is operable to receive the deadbolt.

* * * * *